US007249905B1

(12) United States Patent
Naramoto et al.

(10) Patent No.: US 7,249,905 B1
(45) Date of Patent: Jul. 31, 2007

(54) THRUST-OUT TYPE CONTAINER FOR A ROD-LIKE ARTICLE

(75) Inventors: Satoru Naramoto, Chiba-ken (JP); Yoshinobu Abe, Chiba-ken (JP)

(73) Assignee: Hidan Co., Ltd., Chiba-ken (JP)

( * ) Notice: Subject to any disclaimer, the term of this patent is extended or adjusted under 35 U.S.C. 154(b) by 0 days.

(21) Appl. No.: 11/494,549

(22) Filed: Jul. 28, 2006

(51) Int. Cl.
*B43K 21/08* (2006.01)

(52) U.S. Cl. ..... 401/78; 401/75

(58) Field of Classification Search ..... 401/69, 401/68, 75, 78, 171, 172
See application file for complete search history.

(56) References Cited

U.S. PATENT DOCUMENTS 5,653,338 A * 8/1997 Tani ..... 206/385

FOREIGN PATENT DOCUMENTS

JP 2000-189245 11/2000

* cited by examiner

*Primary Examiner*—David J. Walczak
(74) *Attorney, Agent, or Firm*—Clark & Brody

(57) ABSTRACT

A thrust-out type container for a rod-like article generally comprises a driving cylinder extending in a vertical direction, a cylindrical holder extending in the vertical direction inside the driving cylinder, and a guide cylinder adapted to restrict a movement of the holder so that the holder can not be non-rotatable with respect to the driving cylinder but movable in the vertical direction. The driving cylinder includes an outer cylinder formed on its inner peripheral surface with a first groove and an inner cylinder lying inside the outer cylinder and slidably engaged with the first groove so as to be movable in the vertical direction and formed on its inner peripheral surface with a second groove. An upper portion of the holder defined as a cup is configured so that the rod-like article can be attached thereto and a lower portion of the holder defined as a stem extending downward from the cup is adapted to be slidably engaged with the second groove of the inner cylinder.

1 Claim, 5 Drawing Sheets

THRUST-OUT TYPE CONTAINER FOR A ROD-LIKE ARTICLE

BACKGROUND OF THE INVENTION

The present invention relates generally to a thrust-out type container for a rod-like article such as a lipstick.

A container of this type is well known and an example thereof is disclosed in Japanese Unexamined Patent Application Publication No. 2000-189245. The container disclosed in this Publication extends in a vertical direction and comprises a core cylinder to which the rod-like article is attached, an outer cylinder formed with a groove, and an inner cylinder interposed between these core cylinder and outer cylinder wherein the core cylinder is provided with a pair of arms radially extending from outer peripheral surface of the core so as to be slidably engaged with the groove. The inner cylinder is formed with a pair of guide means through which the respective arms extend toward the groove. These guide means are formed so as to be opposed to each other in radial direction of the inner cylinder and one guide means is an opening extending in the vertical direction through the peripheral wall of the inner cylinder while the other guide means is a U-shaped notch extending downward from the upper edge of the inner cylinder.

In the case of the container disclosed in the Publication, a length by which the rod-like article can be thrust out, i.e., a distance by which the rod-like article can move upward within the container depends on a direct distance from a lower end to an upper end of the groove on the outer cylinder. Therefore, if it is intended to increase the length by which the rod-like article can be thrust out, a vertical dimension (i.e., height) of the container will be inevitably increased. From the viewpoint of the container's design, it may be sometimes required to minimize the vertical dimension of the container in consideration of its appearance. However, it is difficult for the container disclosed in the Publication to fulfill such requirement.

It is an object of the present invention to provide a thrust-out type container for a rod-like article improved so that a vertical dimension of the container can be minimized without reducing the amount of the rod-like article that can be thrust out.

SUMMARY OF THE INVENTION

According to the present invention, there is provided a thrust-out type container for a rod-like article comprises a driving cylinder, a holder and a guide cylinder extending in a vertical direction coaxially one with another.

The driving cylinder includes outer and inner cylinders extending coaxially with each other.

The outer cylinder is formed on its inner peripheral surface with a first groove.

The inner cylinder is set inside the outer cylinder so as to be slidably engaged with the first groove thereby to be movable in the vertical direction and is formed on its inner peripheral surface with a second groove.

The holder is set inside the inner cylinder and has a projection adapted to be slidably engaged with the second groove so that the holder can be moved in the vertical direction. A portion of the holder lying above both the outer cylinder and the inner cylinder is formed on its outer peripheral surface of this portion with a projection extending toward the guide cylinder.

The guide cylinder is set outside said holder. The guide cylinder has a lower portion slidably engaged with one of the inner and outer peripheral surfaces of the circumferential direction and an upper portion extending upward beyond the outer cylinder. The guide cylinder is formed on its inner peripheral surface with a guide groove extending downward from a top edge of the guide cylinder so that the projection is slidably engaged with the guide grooves, thereby the holder can move in the vertical direction but not rotate with respect to the guide cylinder.

According to one preferred embodiment of the present invention, the holder comprises an upper member configured so that the rod-like article can be attached thereto and a lower member adapted to be attached to the upper member from below as viewed in the vertical direction. The upper member is configured so as to be inserted into the guide cylinder from above while the lower member is configured so as to be inserted into the inner cylinder and the guide cylinder from below.

In this thrust-out type container, a direct distance of the groove as measured from the upper end to the lower end of the groove which determines the amount by which the rod-like article can be thrust out is divided a direct distance of the first groove of the outer cylinder and a direct distance of the second groove of the inner cylinder Therefore, compared to the conventional container having non-divided groove, a height of the inventive container can be more effectively reduced.

The holder is divided in upper and lower members so that the upper member previously carrying the lipstick can be inserted into the guide cylinder while the lower member can be inserted into the guide cylinder from below. Then these two members can be put into engagement with each other within the guide cylinder. In this way, the lipstick can be supplied from above the container during the process of assembling the container.

DETAILED DESCRIPTION OF THE PREFERRED EMBODIMENTS

Details of a thrust-out type container for a rod-like article according to the present invention will be more fully understood from the description given hereunder with reference to the accompanying drawings.

Figure 1:
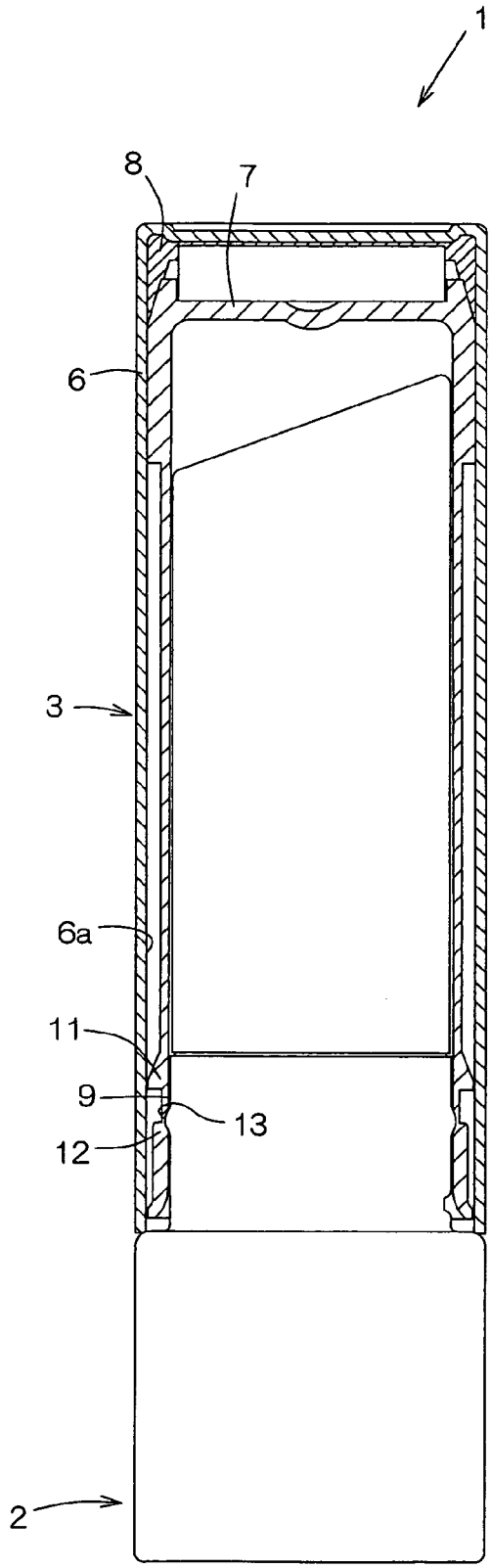
FIG. 1 is a partially cutaway side view showing a container.

FIG. 1 is a partially cutaway side view of a thrust-out type container 1 for lipstick as one embodiment of the present invention. The container 1 has a cylindrical shape which is relatively long in a vertical direction as viewed in FIG. 1 and includes a main body 2 having a thrust-out mechanism for the lipstick 10 (See FIG. 2) and a cap 3 adapted to be detachably put on the main body 2. In FIG. 1, the cap 3 is shown in a sectional view. The cap 3 comprises an outer cap 6 formed by hard plastic material such as ABS resin or metallic material and an elastically deformable inner cap 7 formed by soft plastic material such as low density polyethylene resin. These outer and inner caps 6, 7 are integrated by means of adhesive 8 such as a hot melt adhesive. The inner cap 7 is formed in the vicinity of its lower end with an upper contact zone 11 and a lower contact zone 12 both adapted to be kept in contact with an inner peripheral surface 6*a* of the outer cap 6 and a zone 9 defined between those outer and inner cap 6, 7 so as to be kept spaced from the inner peripheral surface 6*a*. The zone 9 is elastically deformed to come in close contact with a bulge 13 (See FIG. 2) of the main body 2 and thereby to ensure air-tight condition between the main body 2 and the cap 3 so that any ingredient of the lipstick could not be evaporated.

Figure 2:
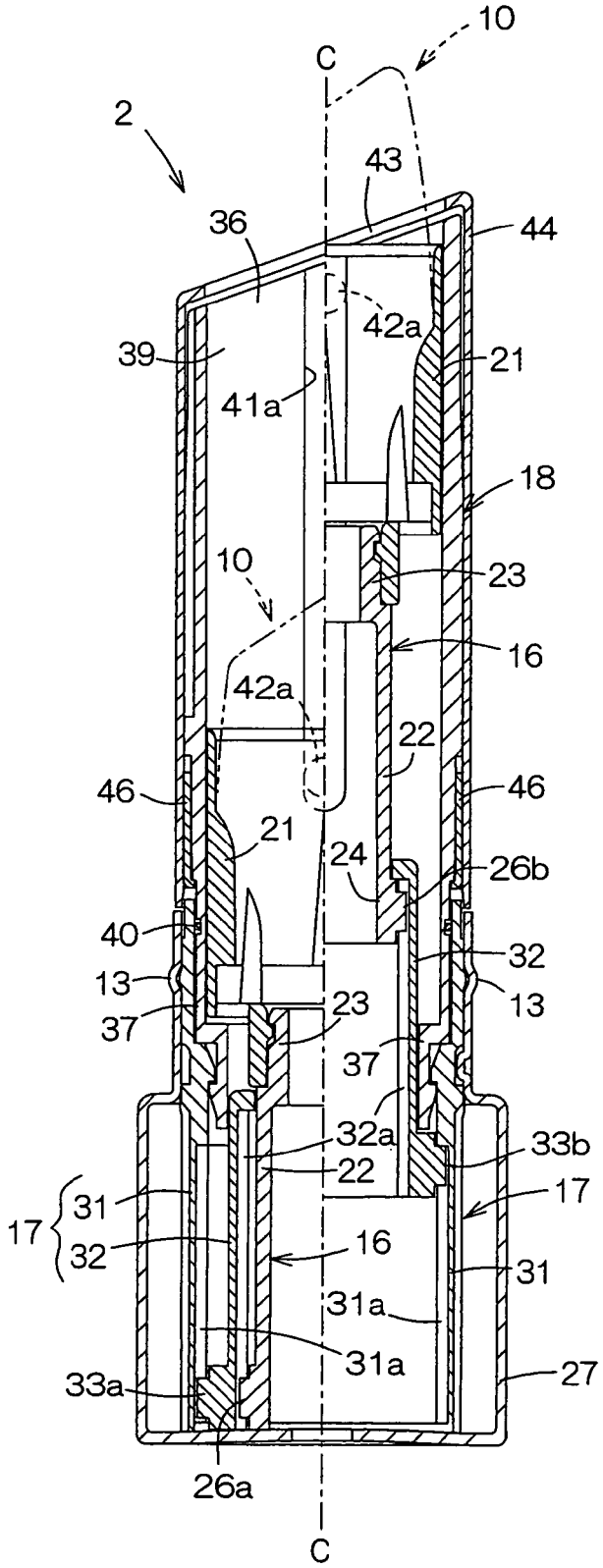
FIG. 2 is a sectional view showing a main body of the container.

FIG. 2 is a sectional view of the main body 2, in which the lipstick 10 is partially indicated by an imaginary line. As will be seen in FIG. 2, the left side of a center line C—C bisecting a width of the main body 2 shows the thrust-out mechanism for the lipstick 10 having lowered the lipstick 10 to the lower limit position within the main body 2 while the right side of the center line C—C shows the thrust-out mechanism having thrust out the lipstick 10 up to the upper limit position. The main body 2 comprises a substantially cylindrical holder 16 configured so that the lipstick 10 can be attached thereto, a driving cylinder 17 formed with a groove adapted to drive the holder 16 upward/downward and thereby to move the lipstick 10 in the thrust-out direction and in the direction opposed thereto, and a guide cylinder 18 adapted to restrict the direction in which the holder 16 moves.

The holder 16 comprises a cup 21 constituting a cylindrical upper member and a stem 22 constituting a cylindrical lower member. The cup 21 (See FIGS. 3 and 4) supports the lipstick 10 from below while the stem 22 extends downward from the lower part of the cup 21 and has its top portion 23 which is elastically deformable radially inward so as to be permanently engaged with a lower portion of the cup 21. The stem 22 is formed on its lower part 24 with a pair of projections 26*a*, 26*b* extending radially outward from the outer peripheral surface thereof so as to be diametrically opposed to each other.

The driving cylinder 17 is coaxial with the holder 16 and comprises an outer cylinder 31 and an inner cylinder 32 which is coaxial with the outer cylinder 31 and set inside the outer cylinder 31. The outer cylinder 31 is formed on its inner peripheral surface with first double-threaded grooves 31*a* extending upward from the lower end to the vicinity of the upper end of the outer cylinder 31. The inner cylinder 32 is formed on its outer peripheral surface with a pair of projections 33*a*, 33*b* extending radially outward and on its inner peripheral surface with second double-threaded grooves 32*a* extending upward from its lower end to the vicinity of its upper end. The paired projections 33*a*, 33*b* of the inner cylinder 32 are diametrically opposed to each other and are adapted to come in engagement with the first double-threaded grooves 31*a*, respectively. The stem 22 of the holder 16 which is coaxial with the inner cylinder 32 is set inside the inner cylinder 32. The paired projections 26*a*, 26*b* of this stem 22 are slidably engaged with the second double-threaded grooves 32*a* of the inner cylinder 32. A cover member 27 having a bottom closed is integrally engaged with the outer cylinder 31 in non-detachable and non-rotatable manner.

The guide cylinder 18 also is coaxial with the holder 16 and has an upper opening 36 defined by a peripheral edge which is slanted with a gradient rising rightward as viewed in FIG. 2. The guide cylinder 18 has its lower end 37 interposed between the outer cylinder 31 and the inner cylinder 32 and engaged with the inner peripheral surface of the outer cylinder 31 in a manner that the guide cylinder 18 can not be detached from the outer cylinder 31 and the guide cylinder 18 and the outer cylinder 31 can be relatively rotated around the center line C—C corresponding to the common axis of these two cylinders 18, 31. An O-ring 40 is interposed between these two cylinders 18, 31. The guide cylinder 18 is formed on its inner peripheral surface 39 with a pair of guide grooves 41*a*, 41*b* (See FIGS. 5 and 6) extending downward from the peripheral edge of the upper opening 36 and diametrically opposed to each other. A pair of projections 42*a*, 42*b* (See FIGS. 3 and 4) formed on the outer peripheral surface of the cup 21 are engaged with those guide grooves 41*a*, 41*b*, respectively, in a manner that the cup 21 can move in the vertical direction and can not move in the circumferential direction with respect to the guide cylinder 18. Consequentially, the holder 16 including the cup 21 is movable with respect to the guide cylinder 18 only in the vertical direction. A cover cylinder 44 having an upper opening 43 is put on the guide cylinder 18 and an annular member 46 is pressed into a space between these two cylinders 18, 44 to ensure that these two cylinders 18, 44 are immovably integrated with each other by means of the annular member 46. While the guide cylinder 18 is exemplarily illustrated to be engaged with the inner peripheral surface of the outer cylinder 31, an alternative arrangement is possible wherein the guide cylinder 18 is engaged with the outer peripheral surface of the outer cylinder 31.

Figure 3:
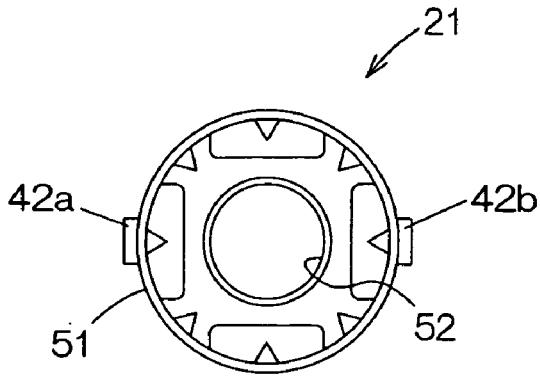
FIG. 3 is a top view showing a cup.
Figure 4:
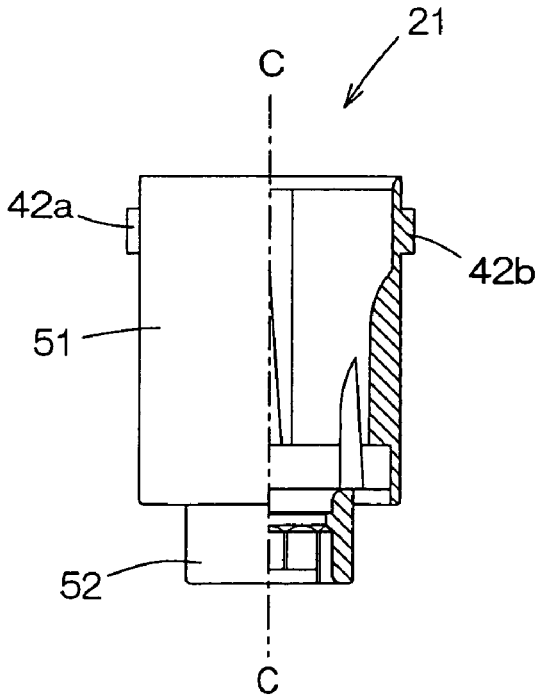
FIG. 4 is a side view showing the cup.

FIG. 3 is a top view showing the cup 21 and FIG. 4 is a side view showing the cup 21 partially cutaway in a sectional view. The cup 21 comprises an upper portion defined by a large diameter cylindrical support 51 serving for the lipstick 10 and a lower portion defined by a small diameter cylindrical joint end 52 adapted to be engaged with the top 23 of the stem 22 in a manner that the stem 22 can not be detached from and rotated with respect to the support 51. The support 51 is formed on its outer peripheral surface with a pair of projections 42*a*, 42*b* diametrically opposed to each other.

Figure 5:
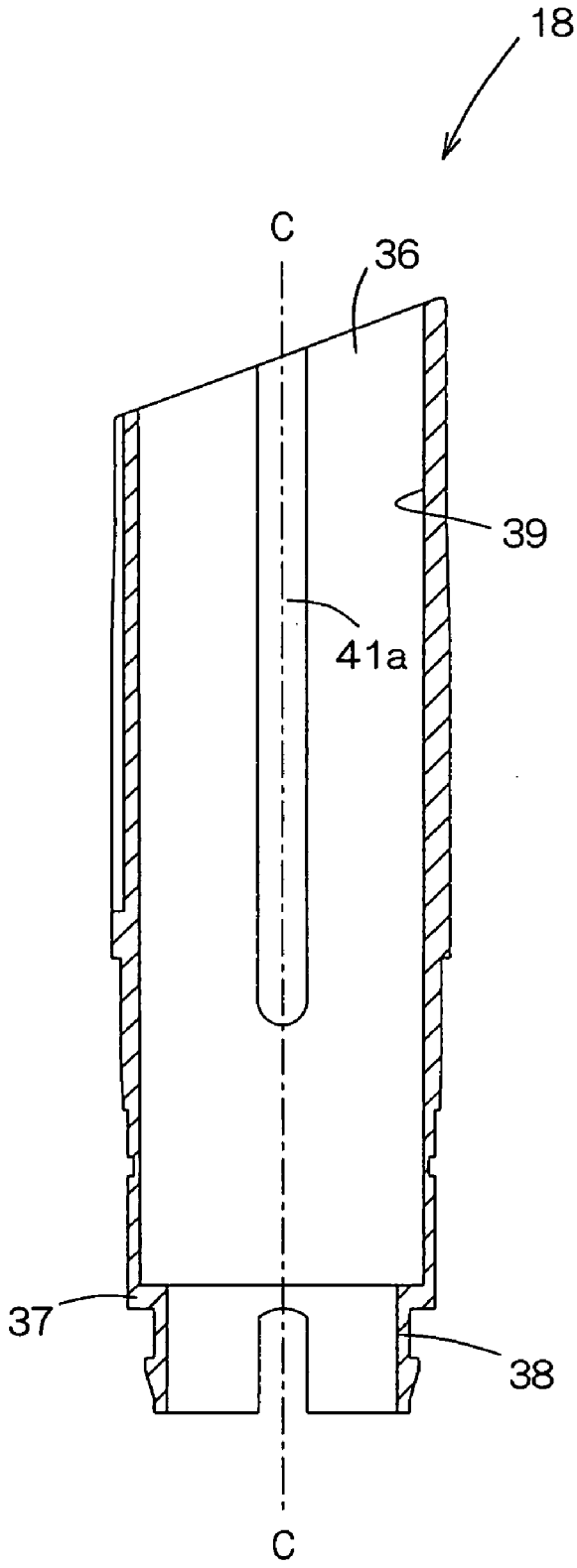
FIG. 5 is a sectional view showing a guide cylinder.
Figure 6:
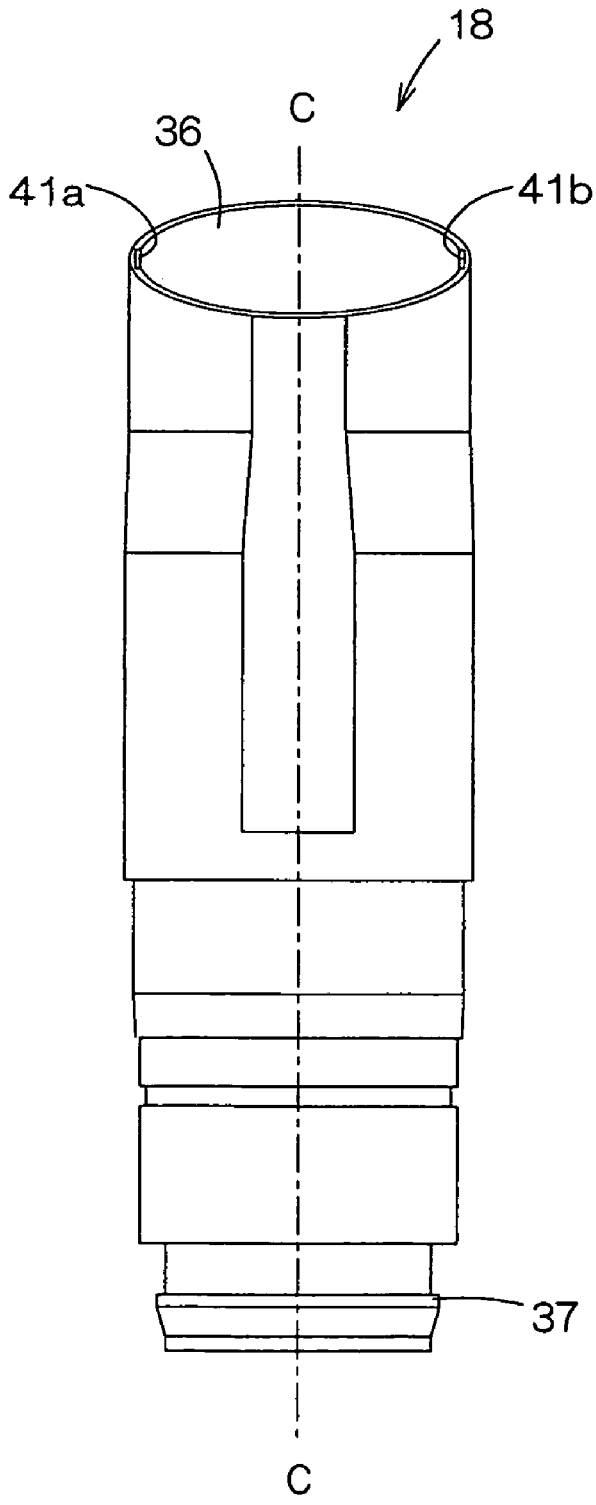
FIG. 6 is a side view showing the guide cylinder of FIG. 5.

FIG. 5 is a sectional view showing the guide cylinder 18 and FIG. 6 is a left side view showing the guide cylinder 18 of FIG. 5. The guide cylinder 18 is formed on its inner peripheral surface 39 with a pair of the guide grooves 41*a*, 41*b* diametrically opposed to each other and vertically extending downward from the peripheral edge of the opening 36. The lower end 37 of the guide cylinder 18 has an insert 38 adapted to be elastically deformed diametrically inward and thereby to be non-detachably engaged with the inner peripheral surface of the outer cylinder 31. The insert 38 comprises a large diameter portion, a small diameter portion and an inverted U-shaped notch.

Now it will be described how to use the thrust-out type container 1 having a basic construction as illustrated in FIGS. 1 and 2. After the cap 3 has been removed, the cover cylinder 44 is held with one hand while the cover member 27 is held with the other hand. Then the cover member 27 may be counterclockwise rotated with respect to the cover cylinder 44 to move the lipstick 10 in the thrust-out direction and the cover member 27 may be clockwise rotated with respect to the cover cylinder 44 to move the lipstick 10 in the opposite direction. More specifically, rotation of the cover member 27 causes the outer cylinder 31 which is integral with this cover member 27 to be rotated and rotation of the outer cylinder 31 causes the inner cylinder 32 to be slidably moved between the upper end and the lower end of the first grooves 31*a* in the thrust-out direction or the opposite direction. Rotation of the inner cylinder 32 causes the stem 22 of the holder 16 to be slidably moved between the upper end and the lower end of the second grooves 32*a* in the thrust-out direction or the opposite direction. In this manner, the lipstick 10 can be moved in the vertical direction as viewed in FIG. 2. In the case of this container 1, as will be apparent from FIG. 2, the amount (height) by which the lipstick 10 can be thrust out is divided in two, i.e., corresponds to a sum of a distance by which the inner cylinder 32 moves in the vertical direction with respect to the outer cylinder 31 and a distance by which the holder 16 moves in the vertical direction with respect to the inner cylinder 32. Compared to the conventional container arranged so that the amount by which the lipstick 10 can be thrust out is not divided in two, a height of the container 1 can be more effectively reduced. In addition, while the container 1 according to the present invention is provided with the guide grooves 41*a*, 41*b* to restrict a movement of the holder 16, it is unnecessary of the container 1 to form the peripheral wall of the guide cylinder 18 with any U-shaped notch extending downward from the top edge of the guide cylinder 18 as the container of the prior art has been the case. Consequentially, the guide cylinder 18 of this container 1 is more rigid than the conventional guide cylinder formed with such notch and correspondingly it is less likely that the guide cylinder 18 might be deformed in the circumferential direction. Even if the cover member 27 is forcibly rotated counterclockwise after the thrust-out amount has already reached its upper limit, the container 1 having such guide cylinder 18 is free from the anxiety that the projections 42*a*, 42*b* of the holder 16 might be easily disengaged from the guide grooves 41*a*, 41*b* and the lipstick 10 might fail to be thrust out as the conventional guide cylinder formed with the U-shaped notch has been the case. In addition, this container 1 advantageously allows the cup 21 to be inserted into the guide cylinder 18 from above since the holder 16 comprises the cup 21 and the stem 22 both prepared separately of each other. Furthermore, the container 1 advantageously allows the stem 22 to be inserted into the guide cylinder 18 set inside the inner cylinder 32 from below so far as it is before the cover member 27 is brought into engagement with the outer cylinder 31. These cup 21 and stem 22 can be put into engagement with each other within the guide cylinder 18. Provided that the lipstick 10 has previously been set on the cup 21, the lipstick 10 can be supplied from above the container 1 during the process of assembling the container 1.

What is claimed is:

1. A thrust-out type container for a rod-like article generally comprising a driving cylinder, a holder and a guide cylinder extending in a vertical direction coaxially one with another, said thrust-out type container further comprising:

said driving cylinder including outer and inner cylinders extending coaxially with each other;

said outer cylinder being formed on its inner peripheral surface with first double-threaded grooves;

said inner cylinder being set inside said outer cylinder so as to be slidably engaged with said first double-threaded grooves thereby to be movable in said vertical direction and being formed on its inner peripheral surface with a second double-threaded grooves;

said holder being set inside said inner cylinder and having a pair of projections adapted to be slidably engaged with said second double-threaded grooves so that said holder is moved in said vertical direction wherein a portion of said holder lying above both said outer cylinder and said inner cylinder is formed on its outer peripheral surface of this portion with a pair of projections extending toward said guide cylinder; and said guide cylinder being set outside said holder, having a lower portion slidably engaged with said outer cylinder so as to be moved in a circumferential direction and an upper portion extending upward beyond said outer cylinder and being formed on its inner peripheral surface with a pair of guide grooves extending downward from a top edge of said guide cylinder so that said pair of projections on said outer peripheral surface of said portion of said holder is slidably engaged with said pair of guide grooves, whereby said holder can move in said vertical direction but not rotate with respect to said guide cylinder, wherein said holder comprises an upper member configured so that said rod-like article can be attached thereto and a lower member adapted to be attached to said upper member from below as viewed in said vertical direction, said upper member is configured so as to be inserted into said guide cylinder from above while said lower member is configured so as to be inserted into said inner cylinder and said guide cylinder from below.

* * * * *